US007788734B2

(12) United States Patent
Menoudakos

(10) Patent No.: US 7,788,734 B2
(45) Date of Patent: Sep. 7, 2010

(54) WAIST BIB

(76) Inventor: Athena Menoudakos, 23 Raymond Ct., Garden City, NY (US) 11530

( * ) Notice: Subject to any disclaimer, the term of this patent is extended or adjusted under 35 U.S.C. 154(b) by 0 days.

(21) Appl. No.: 12/283,691

(22) Filed: Sep. 15, 2008

(65) Prior Publication Data

US 2010/0170023 A1 Jul. 8, 2010

(51) Int. Cl.
*A41B 13/10* (2006.01)
*A41D 13/04* (2006.01)

(52) U.S. Cl. ..... 2/49.2; 2/48

(58) Field of Classification Search ..... 2/46–48, 2/49.1–49.5, 50, 51, 52, 463, 464, 465, 92, 2/88, 102, 104, 247, 248, 250, 251, 252, 2/253, 254

See application file for complete search history.

(56) References Cited

U.S. PATENT DOCUMENTS 563,644 A * 7/1896 Birney ..... 2/49.2
615,293 A * 12/1898 Maier ..... 2/49.2
1,193,545 A * 8/1916 Hart ..... 2/51
1,591,721 A * 7/1926 Melvin ..... 2/49.2
1,620,426 A * 3/1927 Baxter ..... 2/46
D118,418 S * 1/1940 Picken ..... D2/864
2,473,740 A * 6/1949 Welch ..... 2/48
2,517,357 A * 8/1950 Schlegel, Jr. ..... 2/49.2
2,617,103 A * 11/1952 Westgarth ..... 2/48
3,095,576 A * 7/1963 Jenter ..... 2/51
3,540,060 A * 11/1970 Brown ..... 2/49.2
5,504,941 A * 4/1996 Sell ..... 2/49.2
5,819,314 A * 10/1998 Jackson ..... 2/49.2
6,105,165 A * 8/2000 Johnson et al. ..... 2/49.2
2002/0069446 A1 * 6/2002 Pinckney et al. ..... 2/49.1
2007/0028342 A1 * 2/2007 Chan ..... 2/48

* cited by examiner

*Primary Examiner*—Amy B Vanatta
(74) *Attorney, Agent, or Firm*—Douglas C. Wyatt

(57) ABSTRACT

A bib having an apron, a pocket, a waist strap, and a hip strap. The bib is especially useful for young children who may be uncomfortable wearing neck-type bibs.

12 Claims, 3 Drawing Sheets

WAIST BIB

FIELD OF THE INVENTION

This invention is related to the art of protective apparel, and more particularly related to waist bibs for young children and older adults.

BACKGROUND OF THE INVENTION

Neck bibs are often used for young children in order to keep the child clean while eating or engaging in other typical child activities which can often be messy. Such bibs known in the art typically attach at the neck and are often made of absorbent material, such as terrycloth, and cover the upper chest. Some improved bibs include the use of waterproof or water repellent material.

In U.S. Pat. No. 5,530,968, Crockett describes an apron that protects the wearer from food and drink spillage. The apron is formed of a relatively thin sheet of material having tape or other means to close the neck closure portion and seal the sides of the pocket portion in the event that heat sealing is not used. This apron may be provided inexpensively with fast food meals and/or dispensed from a container having a number of aprons packaged separately.

However, young children may not find such bibs desirable to wear. Since such bibs utilize bib portions near the neck, children often find such bibs to be uncomfortable. In addition, bibs having neck connectors can be removed by a child reaching around the back of their neck. This can be especially true of older infants who have learned to remove their neck bibs. In addition, such bibs do not effectively catch food and liquid as their pockets and can collapse when worn over the lap.

In U.S. Pat. No. 6,481,016, Rees describes a baby bib having a body portion of semi-rigid plastics material having a spillage collection scoop. Bibs made of semi-rigid plastic material are not preferred for use with young children. Such bibs are typically difficult to clean as the inside of the scoop can be difficult to scrub if made of soft and/or flexible materials In addition, known bibs typically are only effective when worn around the neck and extend only as far as the waist. When such bibs as described by Rees are made of flexible material so as to be machine-washable and extend to protect the lap, such bibs do not hold the shape of the pocket when worn—especially when the wearer is sitting.

In U.S. Pat. No. 5,490,289, Lehrer describes a baby bib having a panel of absorbent material and a pocket at a lower edge to collect materials which may fall upon the bib and which are not retained by the panel.

Accordingly, there is a need for an improved bib suitable for use with young children. More particularly, there is a need for a bib which can protect clothing or apparel and which cannot be readily removed by a young child.

OBJECT OF THE INVENTION

It is an object of the invention to provide a waist bib for use with young children which is durable, readily cleanable, and easy to use. Another object of the invention is to provide a bib which is acceptable to young children, which does not close around the neck region, and is not readily removable by the wearer.

It is a further object of the invention to provide a bib which is adjustable for a range of child sizes and which meets child safety products standards. It is a further object of the invention to provide a bib that protects clothing against spills of food and liquid, and includes at least one pocket for catching food, liquid, and/or other child articles. Another object of the invention is to provide a bib having a tether and attachment for holding food, a teething device, or toy, among other things.

SUMMARY OF THE INVENTION

A bib is provided suitable for use with young children which can protect clothing or apparel and which cannot be readily removed by a young child. A bib according to the invention is also adaptable for use with older individuals who may feel self-conscious wearing a neck-type bib.

Accordingly, a waist bib is provided comprising a body protector, at least one pocket having a lower boundary and at least one side boundary, an upper chest strap, and a waist strap. The at least one pocket is connected to the body protector at a lower boundary, and includes at least one separable side connector. The side connector separably connects the at least one side boundary to the body protector. The upper chest strap can include a fastener or connector for closing the strap or connecting the strap to a top portion of the body protector. The waist strap includes a connection means and is connected to a bottom portion of the body protector. The body protector can include waterproof, water-resistant and/or absorbent material.

One embodiment of bib can include a bias rib at a top portion of the pocket, which can be used for supporting the pocket and preventing the opening of the pocket from collapsing. The bias rib can be shaped to form two positions and can include at curved portion which can be predisposed to hold the pocket open in a first position. The bias rib includes a tensile portion whereby said bias rib is predisposed to lay substantially flat against the body protector in a second position. The bias rib can be made from thin metal tape and/or plastic spring.

In another embodiment of the invention, at least one separable side connector can include at least one loop and hook connector and at least one pair of complementary ridges to facilitate the closing of the pocket and for preventing fluid from flowing out of the pocket. More specifically, the loop and hook connectors can include several portions of loop and hook connectors arranges substantially in a line. In addition, the two sides of the pocket can be angled towards each other, such as in a V-shape.

In another embodiment, the body protector can include side portions for wrapping around at least a portion of a person's upper body, and can include at least one side pocket. Each of the side pockets can be disposed at an angle with a bottom portion of each side pocket directed away from the center pocket such that side pocket can be directed downwards, and so that the side pockets do not cause the center pocket to close. More specifically, the material between each of the side pockets and central pocket can include stretchable material.

BRIEF DESCRIPTION OF THE DRAWINGS

Preferred embodiments of the inventive devices are illustrated in the drawings and are described below, though not necessarily to scale.

Figure 1:
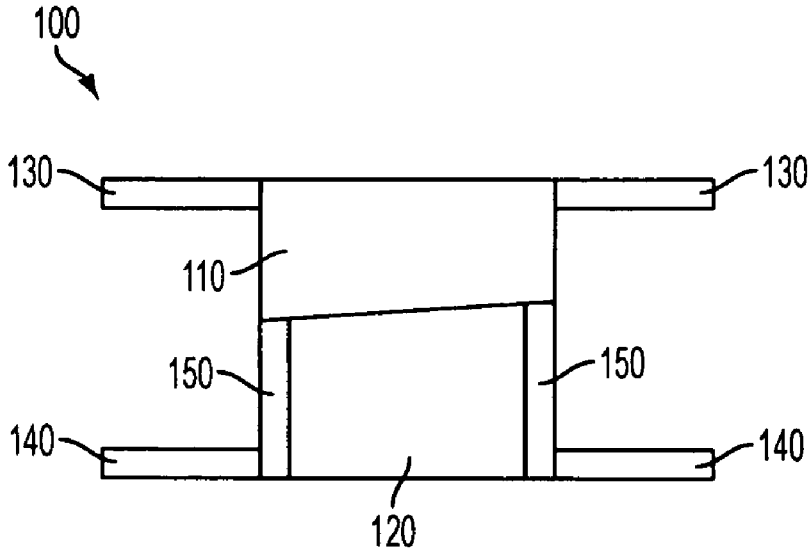
FIG. 1 illustrates a front view of an embodiment of a waist bib according to the invention.

Throughout the figures, the same reference numerals and characters, unless otherwise stated, are used to denote like features, elements, components or portions of the illustrated embodiments. Moreover, while the subject invention will now be described in detail with reference to the figures, it is done so in connection with the illustrative embodiments. It is intended that changes and modifications can be made to the described embodiments without departing from the true scope and spirit of the subject invention as defined by the appended claims.

DETAILED DESCRIPTION

A detailed description of waist bib devices is provided below for general applicability. In addition, several specific embodiments are provided as examples of the devices which one of ordinary skill in the art may apply these teachings to address specific problems and to illustrate the benefits and improvements of the system over known solutions.

A front view of an embodiment of a waist bib (100) according to the invention is shown in FIG. 1. The waist bib (100) includes a body protector (110) or apron, and at least one pocket (120) for catching food, liquid and such items. The body protector (110) is preferably fabricated from flexible material, at least a portion of which can be waterproof, water resistant, and/or absorbent material. For example, the body protector (110) can include fabric having a laminated side, and which can be provided at inner portions of the pocket among other things. The body protector can include material for covering a persons' chest, waist, and/or lap. It can be appreciated that appropriate materials for use with the bib include items that are safe for children.

The pocket (120) can include a lower boundary and at least one side boundary, which connect with the body protector (110) of the bib. The pocket (120) can be formed of the same material as the body protector (110) and can be fabricated with the body protector (110) as a single piece of material. Preferably, the pocket (120) includes at least one separable connector so that the pocket can be opened for cleaning. In one embodiment, the separable connector separably connects at least one side boundary to said body protector at an edge of the pocket (120). The separable connector can be fabricated using conventional connection means, including zippers and loop and hook-type connectors.

The waist bib (100) includes one or more fixtures which can be used for attaching the waist bib (100) to the wearer, such as a chest, waist and/or hip strap. Preferably the waist bib (100) includes a waist strap (130) and a hip strap (140), each being connected to an upper and lower portion of the waist bib (100), respectively. It can be appreciated that the waist strap (130) and hip strap (140) can be adjustably connected to the body protector (110) portion of the bib to adjust the placement of the body protector portion to various body types and sizes, such as the Velrco product sold under the trademark Velcro or Velcro-type devices that have complementary loop and hook connectors. In one embodiment, the waist strap (130) and a hip strap (140) have separable connectors disposed at approximately a middle portion of the waist strap (130) and hip strap (140) such that the connectors are not readily accessible when the wearer is a young child. Connectors include conventional connection means, such as buttons, snaps, belt loops, tabs and slots, among other things.

Figure 2:
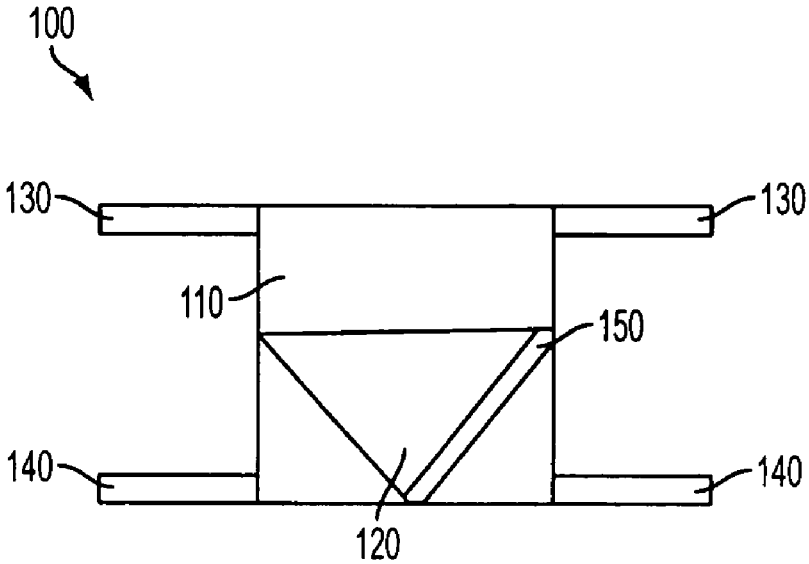
FIG. 2 illustrates a front view of an embodiment of a waist bib according to the invention.
Figure 3:
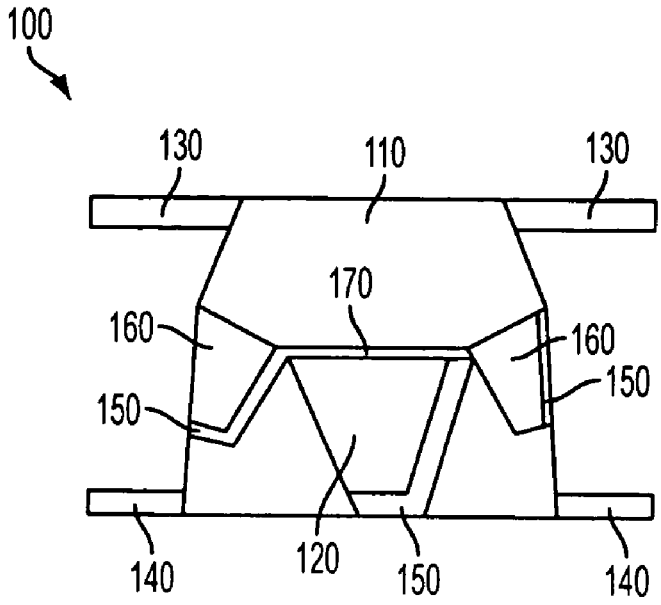
FIG. 3 illustrates a front view of an embodiment of a waist bib according to the invention.

As shown in FIGS. 2 and 3, alternative embodiments of a waist bib according to the invention can include various configurations for the pocket (120). In one embodiment of the bib (100), a pocket (120) is provided in the shape of a triangle to reduce tensions on the pocket (120) which can cause the opening of the pocket to close when the wearer is sitting. Accordingly, the pocket (120) can be provided having the two sides angled towards each other and towards the bottom of the pocket.

As shown in FIG. 3, an embodiment of a bib (100) can include a body protector having side portions for wrapping around at least a portion of a person's upper body. In addition, an embodiment of a bib (100) can be provided with one or more side pockets (160) disposed at the sides of the bib, and arranged with their bottom portions directed away from the center pocket. By providing side pockets (160) in this configuration, the side pockets (160) are less likely to close, such as when the wearer is sitting. In addition, the side portions of the body protector (110) on which the side pockets (160) can be disposed can be made of stretchable material to further improve the object of this configuration. Preferably, the stretchable material is provided between each of the side pockets and a center pocket in such an embodiment.

Alternative embodiments of the invention can be provided with additional means to promote the pockets remaining open, and thereby facilitate the operation of the pockets catching of dropped items. As shown in FIG. 3, an embodiment of a bib (100) can be provided with a rib to support one or more of the pockets. In one configuration, the rib can be provided at the opening of a pocket—such as at a top portion of the pocket—and can be curved to promote a curved opening. It can be appreciated that one or more ribs can be provided at other locations proximate the pocket to promote the pocket remaining open.

Figure 4:
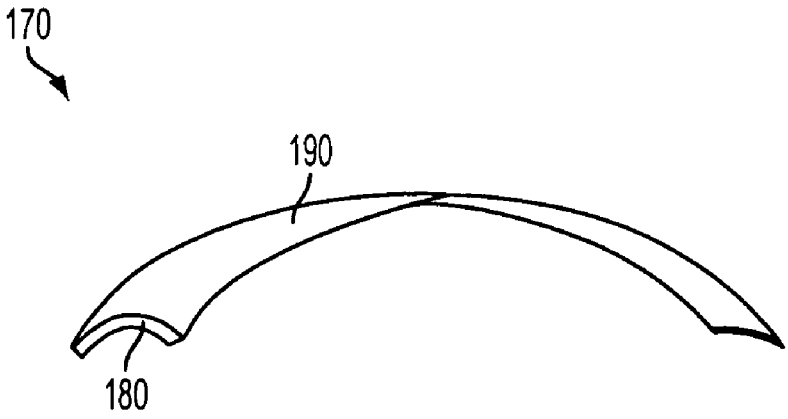
FIG. 4 illustrates a detailed view of bias rib for an embodiment of a waist bib according to the invention.

As shown in FIG. 4, a bias rib can be provided which can both promote the opening of the pocket in one position by remaining curved, and lying in a flatter position when one desires to wash or store the bib (100). One embodiment, a bias rib (170) can be shaped to form two positions and can include a curved portion (180) which can predispose the bias rib (170) remain curved in a first position. In addition, the bias rib (170) can include a tensile portion (190)—such as be pre-stressing the bias rib material—whereby the bias rib (170) can be disposed to lay substantially flat in a second position. The rib can form each position by applying pressure to a side of the rib, in one direction or the other. It can be appreciated that the rib can be fabricated using thin metal tape, and/or plastic spring, among other things.

Figure 5:
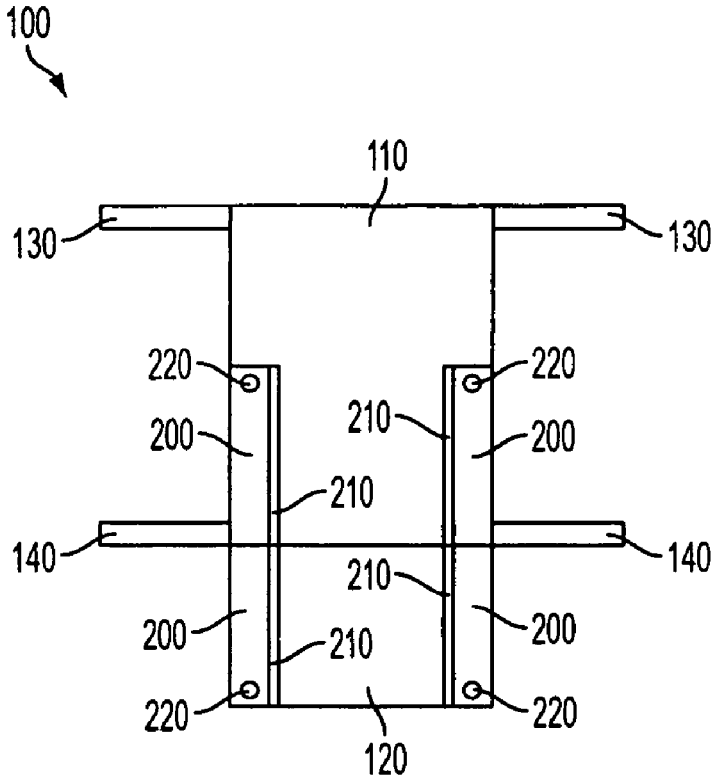
FIG. 5 illustrates a front view of an embodiment of a waist bib according to the invention, wherein the pocket is open for cleaning.
Figure 6:
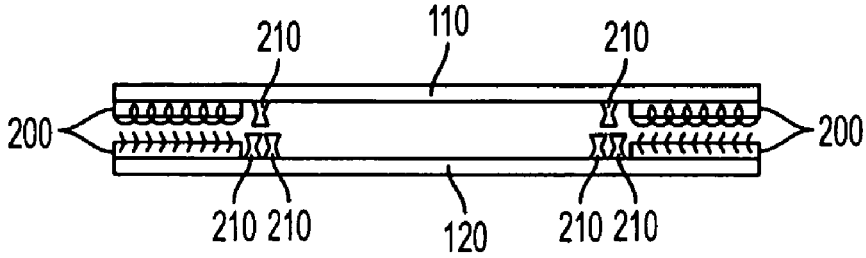
FIG. 6 illustrates a plane view in detail of an additional embodiment of a waist bib according to the invention.

FIG. 5 illustrates a front view of an embodiment of a waist bib according to the invention wherein the pocket is open for cleaning. 5. In one embodiment of a bib (100), at least one separable connector (150) can be provided to include at least one loop and hook connector, and one or more ridges (210). For example, the one loop and hook connector can separably connect the pocket, such as at a side boundary. Several portions of loop and hook connectors can be provided and arranged substantially in a line where the pocket is to be separably connected. In addition, the ridges (210) can be paired at each closure to form a pair of complementary ridges (210) which can cooperate with each other to form a barrier, such as a barrier to liquid. For example, a ridge can be provided at an area on the body protector where the pocket closes, and another ridge can be at the edge of the pocket where the pocket closes so that when the pocket is closed, each ridge functionally cooperates with one another. At least one pair of complementary ridges can be provided on one side of the loop and hook connector strip and a second pair can be provided on the other side. The ridges (210) can be provided to prevent liquid material in the pocket from seeping through the separable connector, as well as to promote the proper alignment and closing of the pocket. As shown in FIG. 6, the loop and hook connectors can cooperate with the ridges to provide an effective closure while preventing liquid from seeping out of the pocket. In addition, other alignment means can be provided. For example, buttons and/or snaps can be provided as alignment fixtures (220) and can facilitate the connection of a separable side of a pocket.

Although preferred embodiments of the wine preservation and delivery system and method have been disclosed, a person of ordinary skill in the art can appreciate that other configurations of the wine preservation system and method are possible and within the scope of the invention.

The invention claimed is:

1. A waist bib, comprising:

a body protector, at least one pocket having a lower boundary and at least one side boundary, an upper chest strap, and a waist strap, wherein the at least one pocket is connected to said body protector at said lower boundary, and includes at least one separable side connector, said side connector separably connecting said at least one side boundary to said body protector, wherein said upper chest strap includes a connection means and is connected to a top portion of the body protector, and wherein the waist strap includes a connection means and is connected to a bottom portion of the body protector, and further comprising a bias rib at a top portion of the pocket, wherein said bias rib is shaped to form two positions, wherein said bias rib includes a curved portion whereby said bias rib is predisposed to hold the pocket open in a first position, and wherein the bias rib includes a tensile portion whereby said bias rib is predisposed to lay substantially flat against the body protector in a second position.

2. A bib according to claim 1, wherein said bias rib is selected from the group consisting of thin metal tape, plastic tape, metal spring, and plastic spring.

3. A bib according to claim 1, wherein said at least one separable side connector includes at least one loop and hook connector, and at least one pair of complementary ridges.

4. A bib according to claim 1, wherein the two side portions of the pocket are angled towards each other in a v-shape.

5. A bib according to claim 3, wherein said at least one loop and hook connector comprises several portions of loop and hook connectors arranged substantially in a line.

6. A bib according to claim 1, wherein the body protector includes side portions for wrapping around at least a portion of a person's upper body.

7. A bib according to claim 1, further comprising at least one side pocket.

8. A bib according to claim 7, wherein the at least one pocket comprise a center pocket, and wherein each at least one side pocket is disposed at an angle, whereby a bottom portion of each side pocket is directed away from the center pocket.

9. A bib according to claim 7, wherein the at least one pocket comprises a center pocket, and further comprising stretchable material between each side pocket and the center pocket.

10. A bib according to claim 1, wherein the body protector further includes water proof material lining said at least one pocket.

11. A bib according to claim 1 wherein said body protector further comprises absorbent material on an outer portion of said body protector.

12. A bib according to claim 1 wherein said waist strap includes connection means disposed at a center of the waist strap.

* * * * *